United States Patent [19]

Mauduit

[11] 4,346,871

[45] Aug. 31, 1982

[54] STRUCTURE FOR AFFIXING METALLIC WIRE TO SUPPORT POSTS

[76] Inventor: Francois M. Mauduit, 12, rue de la Vicomte, 76490 Caudebec-en-Caux, France

[21] Appl. No.: 35,630

[22] Filed: May 3, 1979

[30] Foreign Application Priority Data

May 10, 1978 [FR] France ..... 78 13879

[51] Int. Cl.[3] ..... A01K 3/00

[52] U.S. Cl. ..... 256/10; 256/49; 256/57; 174/163 F

[58] Field of Search ..... 174/158 F, 163 F, 161 F, 174/173; 256/10, 57, 49, 48, 71, 62, 52; 403/390, 397

[56] References Cited

U.S. PATENT DOCUMENTS

| | | | |
|---|---|---|---|
| 1,068,916 | 7/1913 | Moore | 256/57 |
| 1,213,201 | 1/1917 | Hutchinson | 256/48 |
| 2,386,129 | 10/1945 | Maack | 256/10 X |
| 2,438,419 | 3/1948 | Schmidt | 174/163 F |
| 2,805,277 | 9/1957 | Moeller | 256/10 X |
| 3,300,577 | 1/1967 | Baatz | 256/10 X |
| 3,908,964 | 9/1975 | Leiblich | 256/10 |

FOREIGN PATENT DOCUMENTS

| | | | |
|---|---|---|---|
| 806396 | 8/1951 | Fed. Rep. of Germany | 174/158 |
| 969254 | 5/1950 | France | 174/161.2 |
| 754049 | 8/1956 | United Kingdom | 174/158 F |

*Primary Examiner*—Andrew V. Kundrat
*Attorney, Agent, or Firm*—Richard L. Johnston

[57] ABSTRACT

A structure for affixing metallic wire to support posts is provided wherein between each post and each wire there is inserted a piece of non-oxidizable material which is not electrically conductive and which physically separates the wires from the posts with the further provisions that each said post is provided with an opening, said piece of non-oxidizable material is provided with a complemental opening, and said post and piece are tied together with a flexible fixation tying member which passes through said complemental openings and around said metallic wire so as to hold the latter in place against said piece of non-oxidizable material and out of direct contact with said post.

6 Claims, 8 Drawing Figures

STRUCTURE FOR AFFIXING METALLIC WIRE TO SUPPORT POSTS

The present invention concerns a device for fixing metallic wires onto support posts of any type, outside the said support posts and particularly for carrying out enclosures for stock raising, for forests, for tennis courts and enclosures for buildings and factories, for example. Nowadays in order to make such enclosures and in particular in rural areas there are generally used T, X, or round profiled posts which are of metal, or wood, or of concrete, on which are fixed directly iron wires, either barbed or not.

Because of the direct contact between the metallic enclosure wires and the posts, particularly when the latter are metallic, there is an oxidation or rust at the level of each contact, encouraged and set up by the movements of the wires which cause a rubbing of the latter on the posts.

Such oxidation appears even when galvanized iron wires are used because the posts and/or the means for attaching the wires to the posts are unfortunately not galvanized.

The use of galvanized steel posts is in fact very rarely proposed because of their excessive cost.

Similarly, it would become too expensive to plastic-coat the metallic wires, an operation which moreover would not be possible with barbed wire.

The abovementioned oxidation is harmful to the life of the metallic enclosure wires, which rapidly break at the level of their contact with the posts and have to be replaced, whilst they remain in good condition for all of the rest of their length. For this reason it is necessary to be conscious of the fact that breakage is most often brought about when it is desirable to tighten slackened enclosure wires but can also occur spontaneously and without external stress.

It is common for enclosure wires to break at the end of three years' use where the wire is in contact with the support posts even though these metallic wires are sold for a theoretical useful life of the order of 10 years.

Clearly, this effect is greater in a hostile environment (notably of salt air) where it has been shown that wires are corroded for 10 centimeters on each side of the posts.

Even where wooden, concrete or reinforced cement posts, even plastic ones, are used the aforementioned disadvantages still exist because the enclosure wires, barbed or not, galvanized or not, are made fast to the posts by metallic guides anchored in the posts. Thus, metal-to-metal contact still exists and particularly when the repeated rubbing is caused by animals when they lean or rub against the enclosure wires, oxidation or rust progressively appears around each contact between a wire and its metallic guides.

The object of the invention is to eliminate those drawbacks and to allow for preserving the strength of the wires over the whole of their length, which allows considerable prolongation of their life.

To this end the invention has as its object a device for the fixing of metallic wires on support posts outside the latter wherein, between the post and the wire, there is interposed an element composed of a non-oxidizable and non-electrically conducting material physically separating the wires from the posts.

In the first embodiment the element is constituted by a staple at least one portion of which presents a transverse U-section in such a way that the wings of the U grip at least a part of the post, holes being provided in the element as well as in the post in such a way as to allow the passage of a fixing wire to hold the metallic wire against the said element.

In a second embodiment the element includes a passage for the metallic wire to be fixed as well as suitable means for fixing the said element to the support post.

In a third embodiment the element is made up by a sleeve engaged on a staple which insures the fixing of the metallic wires on the posts.

In a fourth embodiment, the element is profiled as an omega of which the flanks of the central portion each have an aperture for passage of an intermediate attachment wire, the metallic wire being held by the said attachment wire against the external face of the top center of the omega shaped element. The latter can be fitted on a hook anchored in the post. In this case, the intermediate attachment wire is in a non-oxidizable material, preferably copper.

In a fifth embodiment, the element has a transverse section in the shape of a Y of which the two upper branches at least partially grip the post and of which the central lower branch is double, its two wings each having a slot which extends substantially vertically on the staple placed in its position of use, each slot extending, one from the lower portion and the other from the upper portion of the staple, over a length such that they will be opposite each other in order to allow the passage of the metallic wire to be fixed in a direction perpendicular to the slots.

Preferably the upper edges of the element which physically separates the wires from the posts are inclined from above to below from the front to the rear of the element and/or from the external face towards the internal face which is in contact with the post.

All of these variants of embodiment defined above guarantee the fixing of metallic wires on the support posts outside the said supports, with a physical separation of the wires relative to the posts and/or to the devices which hook the wires on the posts. The causes of oxidation or of rust are totally eliminated.

In this respect we should remember that none of the known devices in the prior art will allow such an insulation and/or separation.

For example, the device described in Belgian Pat. No. 510,156 consists in having the post crossed by each wire through a rubber sleeve.

French Pat. No. 1,584,616 describes a system for fixing a wire or duct to a post in which there exists a metallic contact between the wire or duct and the post. This system is therefore not suitable to solve the problem of electrical and galvanic insulation between the wire and the post.

Finally, Australian Patent Application No. 17857/70 describes a device for fixing metallic wires onto posts in which the wires are in direct contact with the posts by means of fixing hooks which are metallic. Such a device is therefore unsuited for solving the problem of electrical and galvanic insulation between a wire and a post.

In order to better understand the object of the present invention there will be described hereafter by way of purely illustrative and non-limitative examples, various forms of embodiments with reference to the attached drawings in which FIG. 1 shows an exploded view of one embodiment of the device according to the invention;

Figures 1, 4:
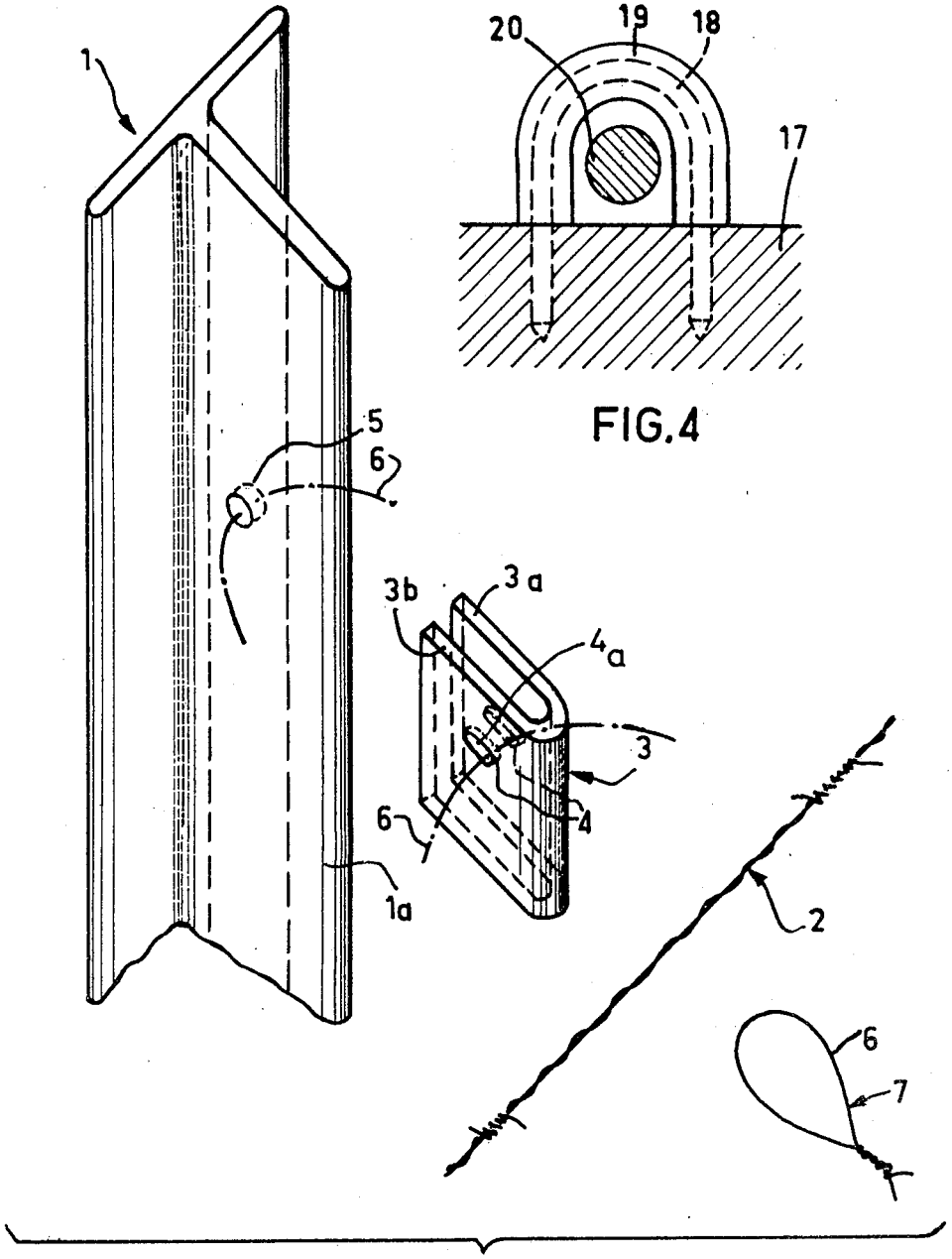
FIG. 4 illustrates a fourth form of embodiment.

In FIG. 1 there is shown a metallic post 1 made up, for example, of a T-iron, for example, in mild steel. This post is part of an enclosure made up of a certain number of identical posts spaced evenly apart on each one of which there are fixed several wires, for example, smooth or barbed galvanized wires as shown at 2 in FIG. 1, arranged parallel to one another and preferably at regular intervals.

In FIG. 1 only a single barbed wire 2 is shown with its device for fixing to the post 1 a device according to the invention.

Between the wire 2 and the support post 1 there is interposed a part 3 in a non-oxidizable non-electrically conductive material, preferably plastic material such as nylon, polyethylene or polyvinyl chloride. The part 3 is made up of a staple formed from a band folded into a U and pierced in the central portion of its two flanks 3*a* and 3*b* by a hole 4 preferably an oblong hole extending perpendicular to the base of the U.

The spacing between the two flanks 3*a* and 3*b* of the staple 3 is such that it allows by a simple pressure the fitting of the latter on one of the wings of the T-iron 1, in this case on the vertical branch 1*a* of the T. In this wing 1*a* there is bored a hole 5, the bore having been provided in such a way that it will come substantially opposite the holes 4 in the staple 3 when this latter straddles the wing 1*a*.

The oblong arrangement 4*a* of the holes 4 allows the holes 4 and 5 to be placed opposite each other. Advantageously the hole 5 is of a diameter greater than the height of the oblong holes 4*a*.

In order to fix the barbed wire 2, this latter is applied against the external face of the central rounded portion of the staple 3 placed on the post 1 and an attachment wire 6 is engaged in the holes 4*a* and 5.

The ends of this intermediate attachment wire 6, which is also of a non-oxidizable material, preferably copper, are turned back and twisted together in order to form a splice, and hold the wire 2 against the staple 3 by a loop as shown at 7 in FIG. 1.

The attachment wire 6 therefore fixes the stable 3 on the post 1 and at the same time holds the wire 2 in contact with the staple.

All the wires, barbed or not, are obviously fixed in the same way to each post of the enclosure.

The enclosure wires are thus physically separated from the soft iron posts and there is no further risk of rusting and/or breaking at right angles of the post attachment systems, even during movements of considerable amplitude of the wires which are caused by animals when they lean against the enclosure.

The method of fixing seen in FIG. 1 applies, of course, to all types of iron wires, smooth or barbed, galvanized or not, as well as to all types of support posts, T or X shaped, for example, having a wing 1*a* which permits the interposition of a U-cross-section staple of which the spacing between the flanks should be adapted to the thickness of the wing 1*a*.

The hole 5 formed in the post 1 has a diameter of five to seven millimeters substantially greater than that of the holes 4, by three millimeters for example, on the one hand to compensate for possible bad centering as has already been explained and, on the other hand, to avoid the attachment wire 6 coming into contact with the post 1.

Figure 2:
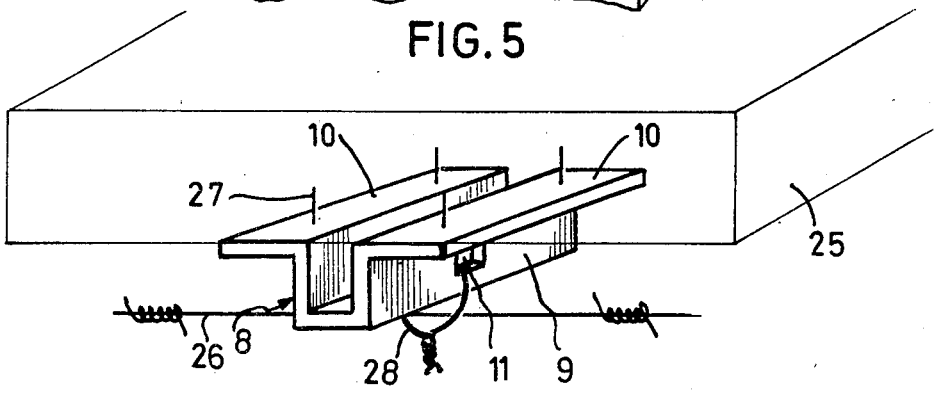
FIG. 2 shows a perspective view of a second form of embodiment.

FIG. 2 shows a second form of embodiment according to which the fixing of the wires 26 on to the post 25 is done by means of a part 8, of omega cross section, including a central portion 9 provided with lateral wings 10 allowing its fixing, by nails 27 or screws or any suitable means, against the flat face of the post 25. This form of embodiment is more particularly intended for wooden or cement posts, the parts 8 being made in a non-oxidizable material allowing, advantageously, them to be nailed to the posts.

Each flank of the central portion 9 of the part 8 is crossed right through by a hole 11 of a rectangular or round section.

The enclosure wire 26 is fixed either in the same way as in FIG. 1, with an attachment wire 28 threaded through the holes 11, the wire 26 in this case bearing against the external face of the portion 9 of the part 8, or by directly threading it through these holes 11, this time without attachment wire. In these two cases the wire 26 is physically separated from the support post by the part 8.

Figure 3:
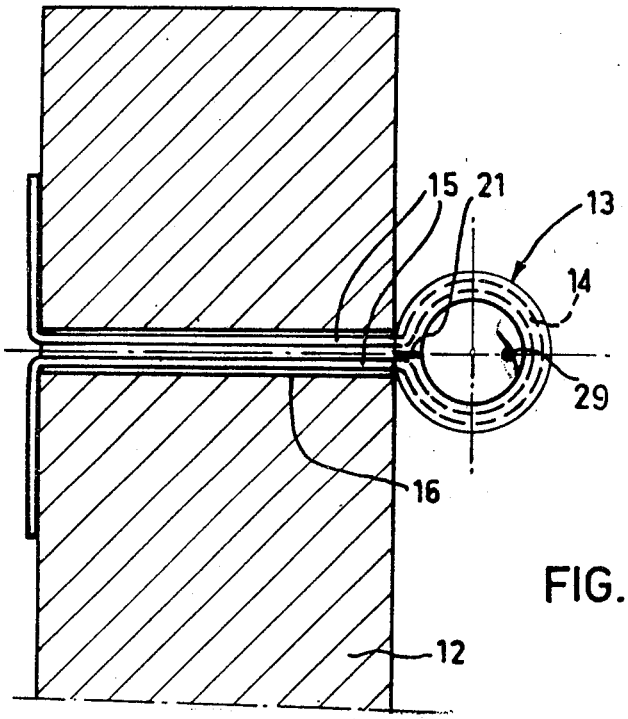
FIG. 3 shows a sectional lateral elevation view of a third form of embodiment.

FIG. 3 shows a third form of embodiment according to which the enclosure wire 29 to be fixed to the post 12 (for example, of wood, metal, plastic or concrete) is threaded through an annular part 13 of rubber or more or less rigid plastic material which is gripped in a metallic loop 14 provided with tabs 15 for fixing onto the post 12.

The loop 14 is preferably lodged in a circular groove provided on the external face of the part 13 in such a way that the loop 14 fits perfectly into the part 13 and that all contact between the enclosure wire 29 and the metallic loop 14 is impossible even by pulling on the wire. The circular groove advantageously has depth greater than the diameter of the wire of the loop 14 in such a way that the loop is buried in the part 13.

The part 13 has either the shape of a torus or that of a cylindrical sleeve. It is advantageously split at 21 through the whole of its thickness. The fixing of the enclosure wire is then obtained by the following method: each end of the wire is attached to a post generally an angle post, having thrust members inclined at about 45° relative to the ground. The intermediate vertical posts allowing the enclosure of the field are anchored into the ground at regular intervals at right angle of the enclosure wire. Then the wire is engaged between the tabs 15 of the loop 14 and then it is forced into the slot 21 until it is freely threaded in the center of the annular part 13.

It is then enough to engage the tabs 15 in a hole 16 formed for this purpose in the post 12 and then to cause them to project from the other side and to turn them down at right angles so that the loop 14 is fixed to the said post and consequently so that the wire shall be held in place relative to the post.

FIG. 4 shows a fourth variant used for non-oxidizable posts 17, a variant in which the wires 20 are fixed in a metallic U-shaped staple 18 and are simply embedded in the post 17, the staple being at its external portion encased in a sleeve 19 of non-oxidizable material and the wire 20 being guided and held imprisoned by the staple 18.

Figure 5:
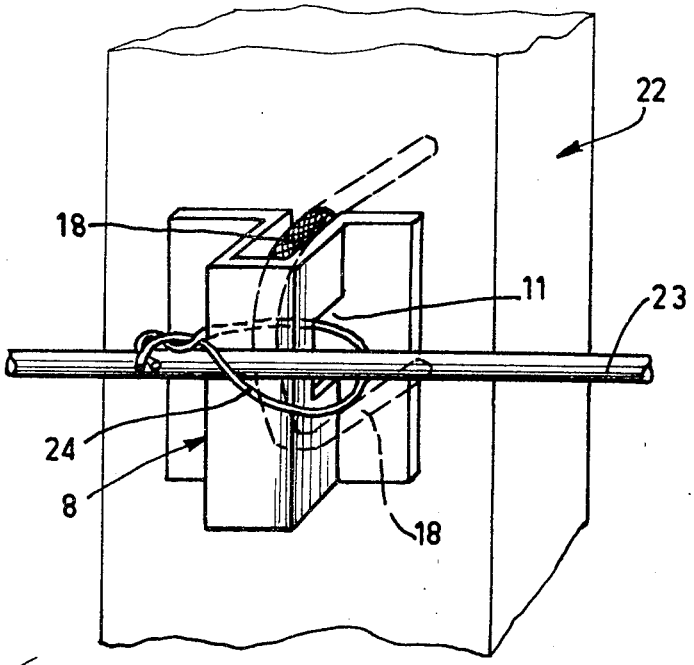
FIG. 5 shows a perspective view of a fifth form of embodiment.

FIG. 5 shows a fifth variant obtained to some extent by combining the devices of FIGS. 2 and 4.

On a metallic U-shaped staple 18 embedded in a post 22 which is oxidizable or non-oxidizable is fitted an omega-shaped part 8 which is in practice already held by friction alone. The enclosure wire 23 is then applied against the external face of the core of the central portion of the part 8; lastly an intermediate attachment wire 24 is introduced into the two holes 11 as well as into the space existing between the staple and the post which is opposite holes 11. The wire 24 is, of course, non-oxidizable and, for example, is advantageously of copper. It thus suffices to form a loop with the attachment wire 24 above the enclosure wire 23, and to twist the ends of the attachment wire so that the enclosure wire 23 is made fast with the post 22, while being separated from any metallic part which is, as a result of repeated rubbing, susceptible to causing oxidation points which would weaken the mechanical characteristics of tension-resistance of the enclosure wire.

Figure 6:
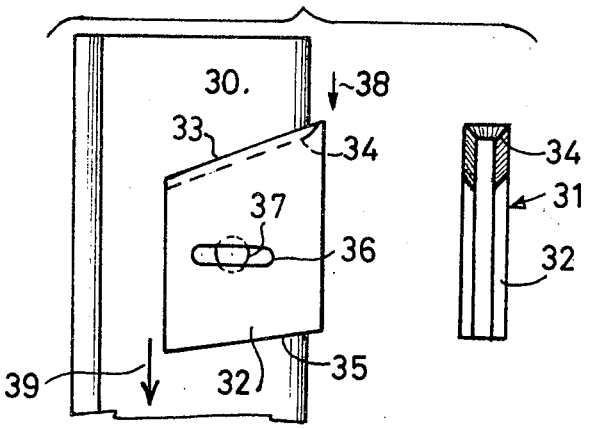
FIG. 6 shows a profile view of a T-post equipped with a U-shaped staple which is a variant of the staple of FIG. 1, as well as a face view of the said staple.

The U-shaped staple shown in FIG. 6 derives directly from the construction shown in FIG. 1, that is to say, it is essentially a U-shaped staple 31 of which the two flanks 32 imprison the wing of a T-cross section iron 30. The fixing of the staple 31 on the post 30 is obtained by means of an intermediate wire of copper going through the hole 37 formed in the post 30 and the oblong slot 36 formed in the flanks 32 of the staple, the said copper wire acting at the same time to fix the enclosure wire.

The staple 31 of FIG. 6 is built such that in case of rain it prevents the access of drops of water onto the enclosure wire from the staple fixing that enclosure wire which is immediately above.

To this end the upper edge 33 of the staple is inclined from above to below from the front, that is, from the region where the enclosure wire bears, toward the rear of the staple. In the same way the upper edge 33 is inclined from above to below, from its external face toward its internal face which is in contact with the post. This additional inclination is obtained by chamfering 34 to be seen in the face view of FIG. 6.

Because of this double inclination, drops of water which fall in the direction indicated by the arrow 38, run along the upper edge 33 toward the rear of the staple 31, then drip as indicated by the arrow 39 toward the bottom of the post 30. Obviously, this avoids drops of water following the contact surface along which the flanks 32 meet the staple 31 and falling in the direction of the arrow 38, onto the enclosure wire of the lower level, in which case there would be a rusting point.

In the same way the lower edge 35 of the staple 31 is also inclined from above to below, from the front to the rear, in such a way that at the lower rear point of the staple 31 drops of water have no tendency to go back toward the front and to drip according to the arrow 38.

Figure 7:
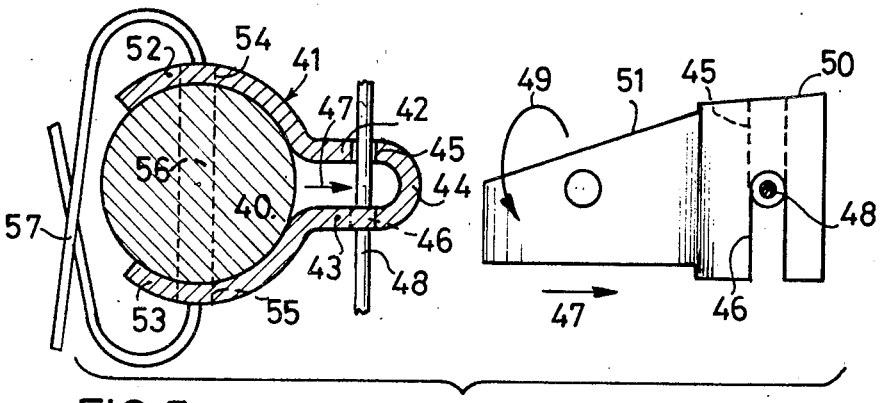
FIG. 7 shows a sectional view from above as well as a profile view of a sixth form of embodiment.

The separation part 41 shown in FIG. 7 has a Y-shaped transverse section of which the two upper branches 52 and 53 grip at least partially the post 40 and of which the central lower branch is formed in two wings respectively 42 and 43 each having a slot, respectively 45 and 46.

On the part 41 placed in its position of use on the post 40 that is to say in the position indicated on the left-hand side of FIG. 7 the slots extend vertically. The slot 45 extends from the upper plane 50 of the part 41 while the slot 46 extends along the lower plane of the part and for a length such that the slots 45 and 46 will be opposite each other to allow the passage of a metallic wire 48 in such a way that this shall be fixed in relation to a direction perpendicular to the slots.

The securing of the wire 48 on the part 41 is done before the latter is fixed to the posts 40.

In this respect it is necessary to refer to the drawing at the right-hand side of FIG. 7 a drawing on which the part 41 is entirely separated from the post 40 and turned through 90° relative to its position of use.

When the part 41 is in this position, the wire 48 is engaged between the wings 52 and 53 and then between the wings 42 and 43 as shown by the arrow 47. When the wire 48 is perpendicular to the slots 45 and 46, the part 41 is pivoted through 90°, as indicated by the arrow 49; the wire 48 is therefore imprisoned inside the slots 45 and 46 and all movement of it is made impossible, both in the vertical and in the horizontal plane.

The part 41 can then be fixed onto the post 40 perhaps with a link wire 57 which goes through a hole 56 formed in the post 40 as well as the holes respectively 54 and 55 formed in the wings 52 and 53. The attachment wire 57 is knotted at the back of the post or in front of the post on the side of the metallic wire 48, but in this case the wire 57 is of copper or the like in order not to oxidize.

In another variant the part 41 is fixed simply by snapping onto the post 40 by reason of the relative resilience of the tabs 52 and 53; this variant is, for example, conceivable for a part 41 made of a plastic material of the PVC type. The attachment by the wire 57 is in this case optional.

Advantageously the upper plane 50 of the part 41 is inclined from above to below, from front to rear, and it connects by a discontinuity to the upper plane of the wings 52 and 53, and plane 51 of which itself is inclined from above to below, from the front to the rear of the part 41, with the obvious aim of encouraging the running away of water drops toward the rear of the post 40 and therefore protecting more efficiently the wire 48 against any source of dampness.

Figure 8:
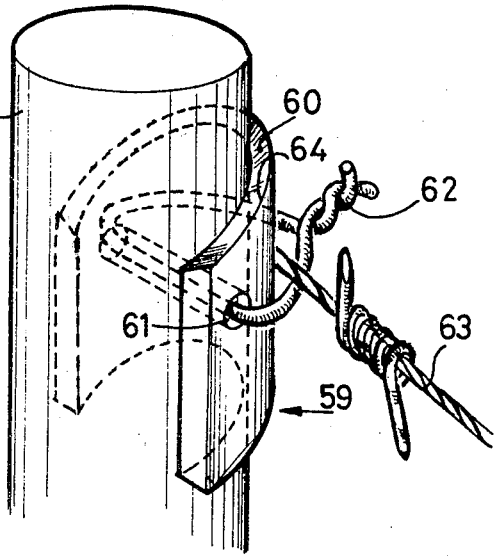
FIG. 8 shows a perspective view of a seventh form of embodiment.

In the last variant shown in FIG. 8 the separation part 59 is in semi-cylindrical form and cooperates with a cylindrical post 58 which is of metal, wood or concrete. The part 69 and the post 58 are successively penetrated by a hole 61 within which there passes an attachment wire 62 preferably of copper which at the same time grips from in front the iron barbed wire 63.

Preferably the upper edge 60 of the separator 59 is incline from above to below, from the rear towards the front of the separator and it is furthermore provided with a chamfer 64, both encouraging a run-away of the drops of water toward the rear of the post and therefore protecting the barbed wire 63 of the level below.

The invention is applicable to all types of enclosures, including stock raising, state forests, tennis courts, using smooth or barbed wire and even for netting, and it is not necessarily limited to the various embodiments shown and described above. It encompasses on the contrary all variants, especially those dealing with the shape of the separation piece interposed between the support posts and the enclosure wires to be supported, likewise the nature of the material making up the said insulation part.

It will be noted that all parts described above because of the insulation guaranteed between each enclosure wire and each post, evidently allow the fixing, without further modification of electrified enclosure wires or netting, this is especially so of the variant shown in FIG. 7.

I claim:

1. A device for fixing metallic wires on support posts, externally to same, characterized in that between each post and each wire there is inserted a piece of non-oxidizable material which is not electrically conductive and which physically separates the wires from the posts, with the further provisions that said post is provided with an opening, said piece of non-oxidizable material is provided with a complemental opening, and said post and piece are tied together with a flexible fixation tying member which passes through said complemental openings and around said metallic wire so as to hold the latter in place against said piece of non-oxidizable material and out of direct contact with the said post.

2. A device according to claim 1, characterized in that the piece is constituted by a staple one part of which at least presents a U-shaped cross section so that the wings of the U enclose at least a part of the post, holes being provided in said part, as well as in the post, so as to permit the passage of a fixation wire which holds the metallic wire against said piece.

3. A device according to claim 2, characterized in that said hole provided in each wing of the staple has a diameter slightly inferior less than to that of the hole provided for in the post.

4. A device according to claim 3, characterized in that said hole provided for in each wing of the staple is oblong in shape and extends in the horizontal direction of the staple placed in its position of use.

5. A device according to any one of claims 2, 3, or 4, characterized in that the intermediary fixation wire is of a non-oxidizable material, preferably copper.

6. A device according to claim 1, characterized in that the upper edges of the piece are slanted from top to bottom, from the external face toward the internal face which is in contact with the post.

* * * * *